US008087575B2

(12) United States Patent
Tiang et al.

(10) Patent No.: US 8,087,575 B2
(45) Date of Patent: Jan. 3, 2012

(54) PRINTER WITH A TOUCH PANEL

(75) Inventors: See-Hing Tiang, City of Industry, CA (US); Khairil Singgih, City of Industry, CA (US)

(73) Assignee: Even Systems Company, Ltd., Taipei (TW)

( * ) Notice: Subject to any disclaimer, the term of this patent is extended or adjusted under 35 U.S.C. 154(b) by 221 days.

(21) Appl. No.: 12/654,726

(22) Filed: Dec. 30, 2009

(65) Prior Publication Data

US 2011/0158678 A1 Jun. 30, 2011

(51) Int. Cl.
*G07G 1/00* (2006.01)
*G03G 15/00* (2006.01)

(52) U.S. Cl. ..... 235/2; 235/7 R; 399/107

(58) Field of Classification Search ..... 235/2, 4, 235/7 R; 705/24; 399/107, 110, 111
See application file for complete search history.

(56) References Cited

U.S. PATENT DOCUMENTS 4,449,186 A * 5/1984 Kelly et al. ..... 705/5
4,912,563 A * 3/1990 Narita ..... 399/110 X
4,926,219 A * 5/1990 Hirasawa et al. ..... 399/90
4,992,645 A * 2/1991 Kasahara et al. ..... 235/2 X
5,569,895 A * 10/1996 Lynch et al. ..... 235/7 R X
6,126,340 A * 10/2000 Ono et al. ..... 235/7 R X
6,168,076 B1 * 1/2001 Yamamoto et al. ..... 235/7 R
6,857,804 B2 * 2/2005 Luciano et al. ..... 400/691
7,336,916 B2 * 2/2008 Jung et al. ..... 399/111
2004/0049426 A1 * 3/2004 Miyagawa ..... 705/16
2007/0286632 A1 * 12/2007 Okabe ..... 399/111 X
2008/0181658 A1 * 7/2008 Okabe ..... 399/111
2008/0226331 A1 * 9/2008 Allen et al. ..... 399/111 X

* cited by examiner

*Primary Examiner* — Sandra Brase
(74) *Attorney, Agent, or Firm* — Bacon & Thomas, PLLC

(57) ABSTRACT

A printer has a base, a cover, a touch panel, a printing module and a detachable bracket. The base has two mounting rails. Each mounting rail has an engaging slot and an engaging protrusion. The cover is mounted detachably on the base. The touch panel is mounted on the base. The printing module is mounted detachably on the base and covered by the cover. The detachable bracket is mounted securely on the printing module and has a bottom plate and two opposite side plates. Each side plate has an engaging tab and an engaging notch detachably engaging the engaging slot and protrusion of a corresponding mounting rail. The printer with the mounting rails and detachable bracket allows the printing module to be repaired independently without disassembling the touch panel.

8 Claims, 7 Drawing Sheets

PRINTER WITH A TOUCH PANEL

BACKGROUND OF THE INVENTION

1. Field of the Invention

The present invention relates to a printer, and more particularly to a printer that has a base, a touch panel and a printing module mounted detachably on the base. The printing module may be detached easily and conveniently from the base easily for repair and maintenance.

2. Description of Related Art

Ordering/checkout machines are commonly electronic devices used on counters in restaurants, department stores, supermarkets and grocery stores for ordering dishes and paying. A conventional ordering/checkout machine has a monitor and a keyboard for inputting orders therein. An improved ordering/checkout machine with a touch panel, which is more compact, has been developed recently so that a user may quickly input an order or goods information into the ordering/checkout machine on through the touch panel. Accordingly, working efficiency is increased to prevent customers intending to pay from waiting in a long queue.

The aforementioned ordering/checkout machine also has a printer incorporated with the touch panel so is capable of printing order/good lists as notes or for checking between clerks and customers. Because the printer is incorporated with the touch panel ordering/checkout machine, repairing the printer requires disassembly of the touch panel, which is time wasting and lowers repairing efficiency.

To overcome the shortcomings, the present invention provides a printer with a touch panel to mitigate or obviate the aforementioned problems.

SUMMARY OF THE INVENTION

The main objective of the invention is to provide a printer that has a base, a touch panel and a printing module mounted detachably on the base. The printing module may be detached easily and conveniently from the base easily for repair and maintenance.

A printer in accordance with the present invention has a base, a cover, a touch panel, a printing module and a detachable bracket. The base has two mounting rails. Each mounting rail has an engaging slot and an engaging protrusion. The cover is mounted detachably on the base. The touch panel is mounted on the base. The printing module is mounted detachably on the base and covered by the cover. The detachable bracket is mounted securely on the printing module and has a bottom plate and two opposite side plates. Each side plate has an engaging tab and an engaging notch detachably engaging the engaging slot and protrusion of a corresponding mounting rail.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
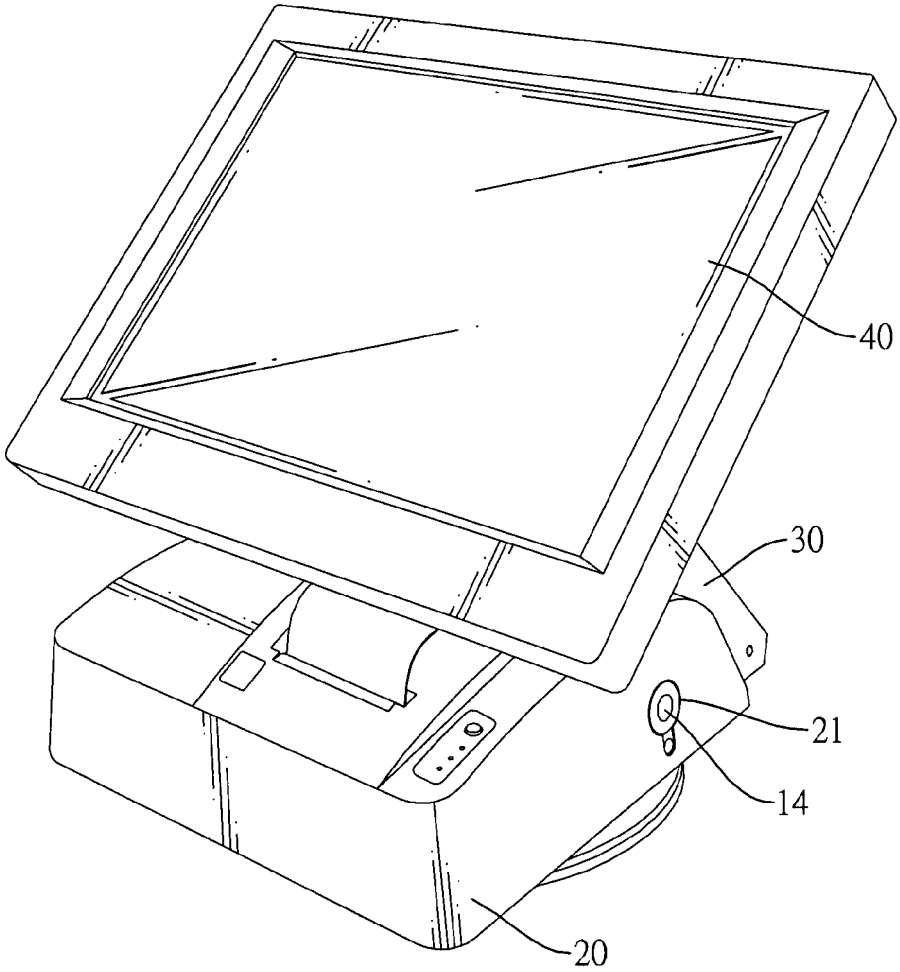
FIG. 1 is a perspective view of a printer with a touch panel in accordance with the present invention.
Figure 2:
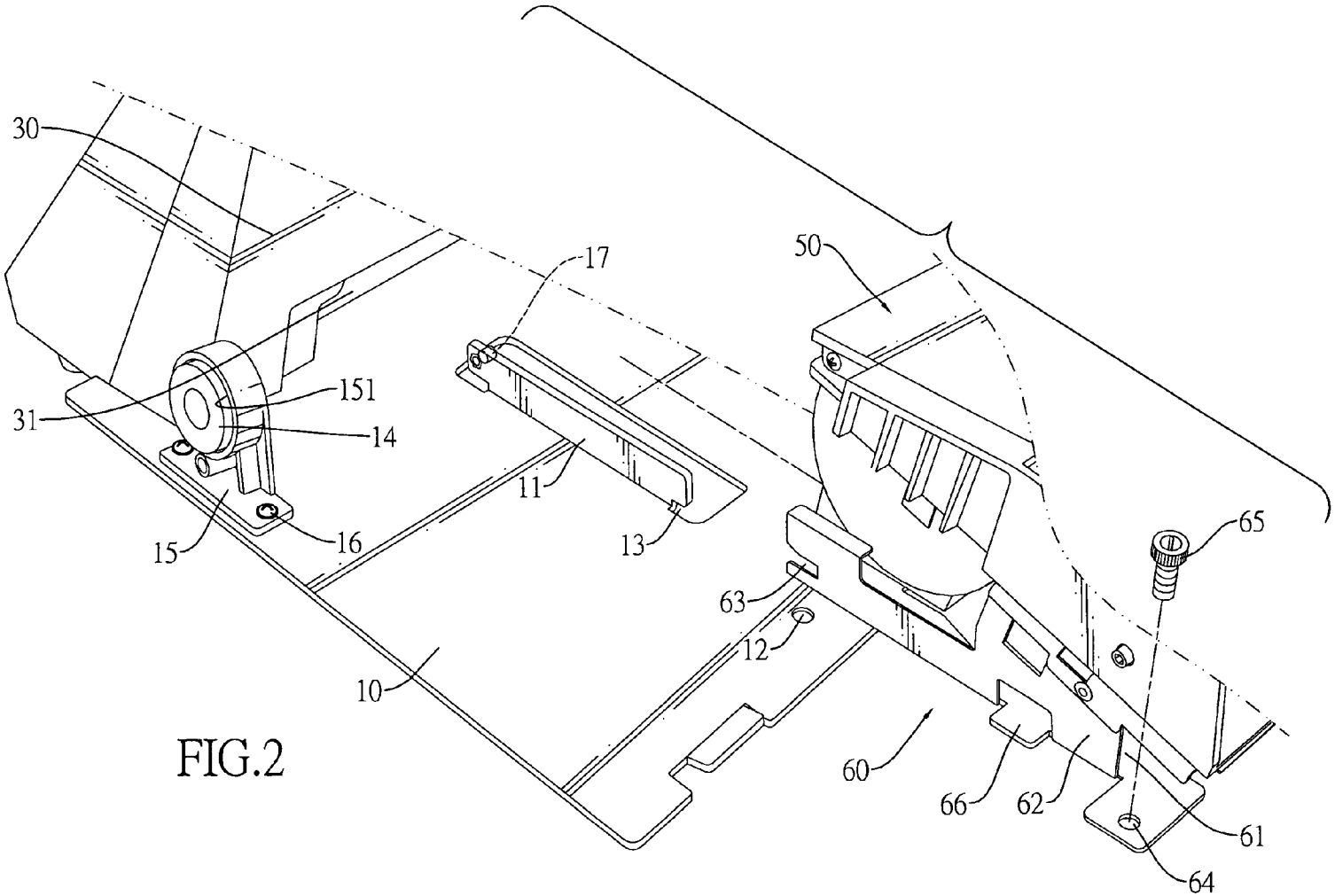
FIG. 2 is an exploded perspective view of the printer in FIG. 1.
Figure 3:
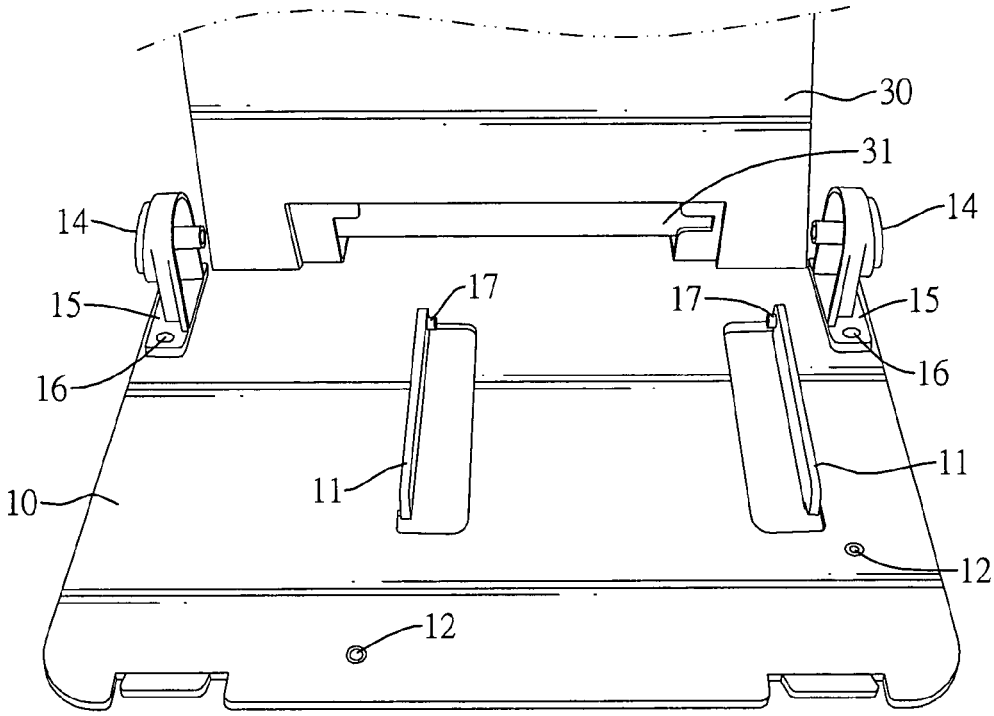
FIG. 3 is a front perspective view of a base of the printer in FIG. 2.

With reference to FIGS. 1 to 3, a printer in accordance with the present invention comprises a base (10), a cover (20), a touch panel (40), a printing module (50) and a detachable bracket (60).

The base (10) has a front, a rear, a top surface and two mounting rails (11) and may further have two pin brackets (15), two retractable locking pins (14), multiple fastening holes (12) and a supporting bracket (30).

The mounting rails (11) are mounted oppositely on the top surface of the base (10) and are parallel to each other. Each mounting rail (11) has a front end, a rear end, an inside, an outside, an engaging slot (13) and an engaging protrusion (17). The engaging slot (13) is defined in the front end. The engaging protrusion (17) is formed on and protrudes transversely from the inside.

The pin brackets (15) are mounted oppositely on the top surface of the base (10). Each pin bracket (15) may be fastened on the top surface through multiple fasteners (16) such as bolts and has a pin hole (151) defined in the pin bracket (15).

The retractable locking pins (14) correspond to and are mounted respectively in the pin holes (151) of the pin brackets (15), protrude respectively from the pin brackets (15) and are capable of retracting respectively into the pin brackets (15). Furthermore, each retractable locking pin (14) may be forced by a spring in a corresponding pin bracket (15) to extend out.

The fastening holes (12) are defined through the base (10) and may be threaded.

The supporting bracket (30) is mounted securely on the top surface at the rear of the base (10) and may have a cable hole (31). The cable hole (31) is defined through the supporting bracket (30) to allow data transmission and power cables to extend therethrough.

The cover (20) is hollow, is mounted detachably on the base (10) and may have two sides and two locking holes (21). The locking holes (21) are defined respectively through the sides and detachably and respectively engage the retractable locking pins (14) of the base (10). Pushing and disengaging the locking pins (14) from the locking holes (21) allows the cover (20) to be detached from the base (10).

The touch panel (40) is connected to the base (10) and may be connected pivotally to the supporting bracket (30) so that a user may pivot the touch panel (40) for optimizing elevational angle of the touch panel (40).

Figure 6:
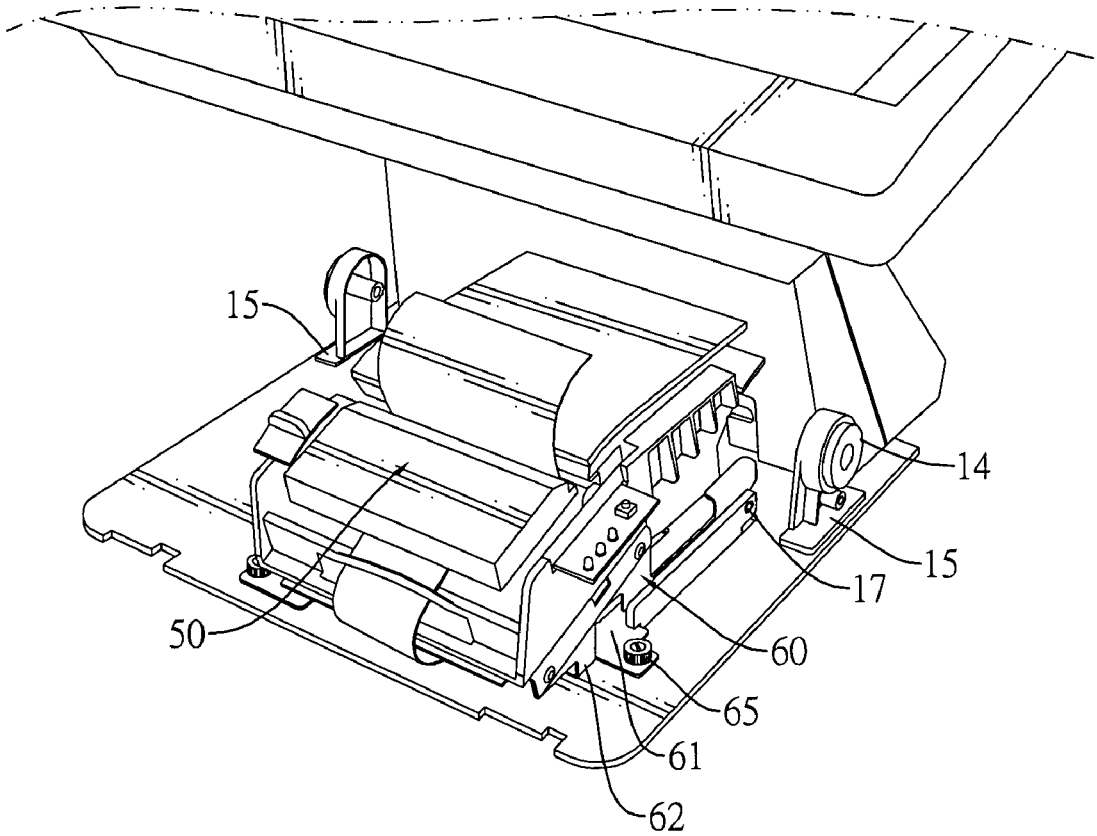
FIG. 6 is a perspective view of the printer in FIG. 1 without a cover.

With further reference to FIG. 6, the printing module (50) is mounted detachably on the base (10), covered by the cover (20) and electrically connected to the touch panel (40) through cables such as power and data transmission cables.

Figure 4:
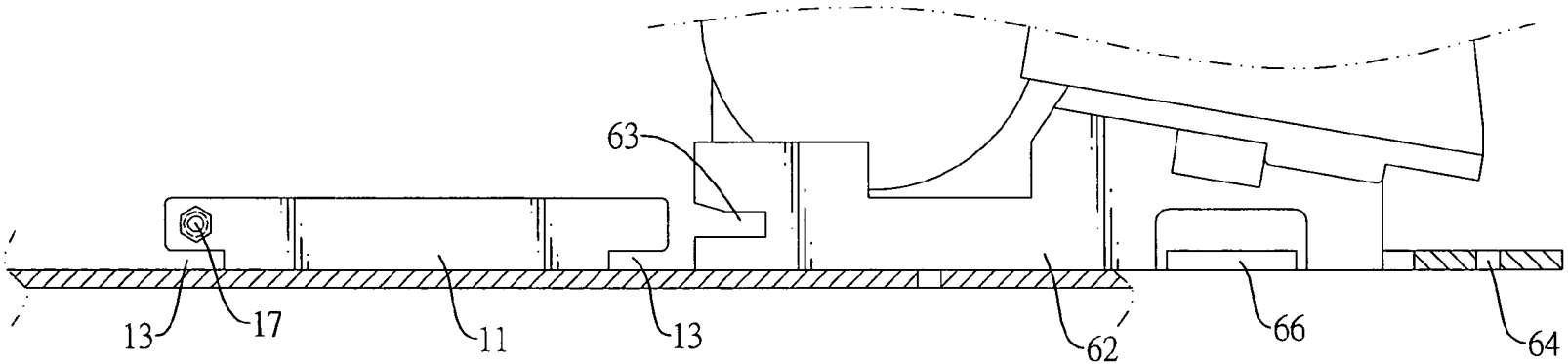
FIG. 4 is an operational cross sectional side view of the printer in FIG. 2.
Figure 5:
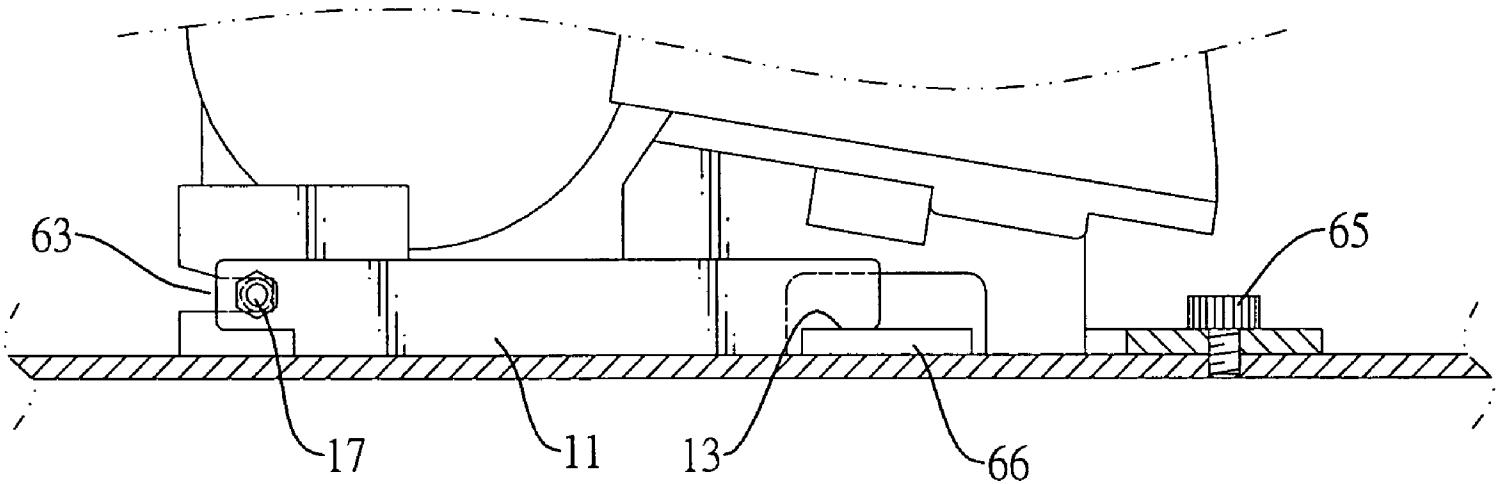
FIG. 5 is an operational cross sectional side view of the printer in FIG. 4.

With further reference to FIGS. 4 and 5, the detachable bracket (60) is mounted securely on the printing module (50) and detachably engages the mounting rails (11) of the base (10) so that the printing module (50) is mounted detachably on the base (10) through the detachable bracket (60). The detachable bracket (60) has a bottom plate (61) and two opposite side plates (62) and may further have multiple fastening bores (64) and multiple fastening elements (65).

The bottom plate is mounted securely under the printing module (50).

Figure 7:
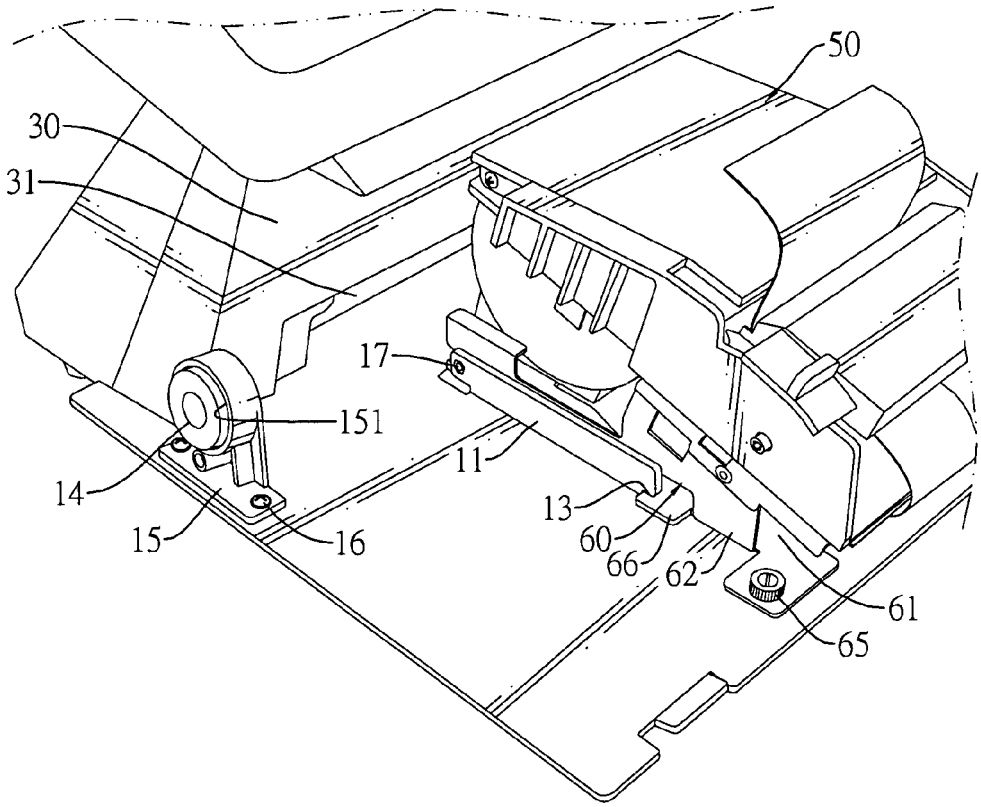
FIG. 7 is an enlarged perspective view of the printer in FIG. 6.

With further reference to FIG. 7, the side plates (62) are formed on and protrude upward from the bottom plate (61) and correspond to and detachably, slidably and respectively engages the mounting rails (11) of the base (10). Each side plate (62) has a front end, a rear end, an engaging tab (66) and an engaging notch (63). The engaging tab (66) is formed on and protrudes transversely outward from the side plate (62) and detachably engages the engaging slot (13) of a corresponding mounting rail (11). The engaging notch (63) is defined in the rear end of the side plate (62) and detachably engages the engaging protrusion (17) of the corresponding mounting rail (11).

The fastening bores (64) are defined through the bottom plate (61).

The fastening elements (65) are detachably mounted respectively through the fastening bores (64) and detachably mounted respectively in the fastening holes (12) of the base (10) so that the detachable bracket (60) is fastened on the base (10) without inadvertently disassembling.

The printing module (50) detachably mounted on the base (10) through the mounting rails (11) and the detachable bracket (60) is easily and conveniently disassembled for independent repair and maintenance without disassembling the touch panel (40). Therefore, repairing and maintaining the printing module (50) is simple and quick.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A printer comprising:

a base having a front, a rear and a top surface and further having two mounting rails mounted oppositely on the top surface and each mounting rail having a front end and a rear end and further having an engaging slot defined in the front end; and an engaging protrusion formed on protruding transversely from the mounting rail;

a cover mounted detachably on the base;

a touch panel connected to the base;

a printing module mounted detachably on the base, covered by the cover and connected electrically to the touch panel; and a detachable bracket mounted securely on the printed module, detachably engaging the mounting rails of the base to make the printing module detachably mounted on the base and having a bottom plate mounted securely under the printing module; and two opposite side plates formed on and protruding upward from the bottom plate and corresponding to and detachably, slidably and respectively engaging the mounting rails of the base, and each side plate having a front end and a rear end and further having an engaging tab formed on and protruding transversely outward from the side plate and detachably engaging the engaging slot of a corresponding mounting rail; and an engaging notch defined in the rear end of the side plate and detachably engaging the engaging protrusion of the corresponding mounting rail.

2. The printer as claimed in claim 1, wherein the base further has two pin brackets mounted oppositely on the top surface of the base and each pin bracket having a pin hole defined in the pin bracket; and two retractable locking pins corresponding to and mounted respectively in the pin holes of the pin brackets, protruding respectively from the pin brackets and being capable of retracting respectively into the pin brackets; and the cover has two sides; and two locking holes defined respectively through the sides and detachably and respectively engaging the retractable locking pins of the base.

3. The printer as claimed in claim 2, wherein the base further has multiple fastening holes defined through the base; and the detachable bracket further has multiple fastening bores defined through the bottom plates; and multiple fastening elements detachably mounted respectively through the fastening bores and detachably mounted respectively in the fastening holes of the base.

4. The printer as claimed in claim 3, wherein the base further has a supporting bracket mounted securely on the top surface of the base; and the touch panel is connected pivotally to the supporting bracket.

5. The printer as claimed in claim 4, wherein the supporting bracket further has a cable hole defined through the supporting bracket.

6. The printer as claimed in claim 5, wherein each pin bracket is mounted on the base through multiple fasteners.

7. The printer as claimed in claim 2, wherein each pin bracket is mounted on the base through multiple fasteners.

8. The printer as claimed in claim 1, wherein the base further has a supporting bracket mounted securely on the top surface of the base; and the touch panel is connected pivotally to the supporting bracket.

* * * * *